US010196873B2

(12) United States Patent
Levett et al.

(10) Patent No.: US 10,196,873 B2
(45) Date of Patent: Feb. 5, 2019

(54) ADVANCED BLOW-OUT PREVENTER

(71) Applicant: Transocean Innovation Labs Ltd., Grand Cayman (KY)

(72) Inventors: Bryce Levett, Katy, TX (US); Gerard M. Ludtka, Oak Ridge, TN (US); Mariana Dionisio, Houston, TX (US)

(73) Assignee: Transocean Innovation Labs Ltd., Grand Cayman (KY)

( * ) Notice: Subject to any disclaimer, the term of this patent is extended or adjusted under 35 U.S.C. 154(b) by 0 days.

(21) Appl. No.: 14/061,435

(22) Filed: Oct. 23, 2013

(65) Prior Publication Data

US 2014/0110610 A1 Apr. 24, 2014

Related U.S. Application Data

(60) Provisional application No. 61/717,459, filed on Oct. 23, 2012.

(51) Int. Cl.
*E21B 33/06* (2006.01)

(52) U.S. Cl.
CPC ..... *E21B 33/06* (2013.01)

(58) Field of Classification Search
CPC ..... E21B 33/06; E21B 33/08; E21B 33/126
USPC ..... 251/1.1, 1.2, 1.3
See application file for complete search history.

(56) References Cited

U.S. PATENT DOCUMENTS

| | | | | |
|---|---|---|---|---|
| 524,956 | A * | 8/1894 | Samper | D01B 1/10 19/17 |
| 3,084,898 | A * | 4/1963 | Miller | E21B 33/06 137/601.02 |
| 3,561,723 | A * | 2/1971 | Cugini | 251/1.2 |
| 3,887,158 | A * | 6/1975 | Polk | E21B 33/06 137/462 |
| 4,098,516 | A | 7/1978 | Murman | |
| 4,458,876 | A | 7/1984 | Schaeper et al. | |
| 5,251,869 | A | 10/1993 | Mason | 251/1.2 |
| 5,620,020 | A | 4/1997 | Collins | 137/318 |

(Continued)

FOREIGN PATENT DOCUMENTS

| | | |
|---|---|---|
| CN | 1068179 A | 1/1993 |
| DE | 198 58 268 | 3/2000 |

(Continued)

OTHER PUBLICATIONS

International Search Report in International Application No. PCT/US2013/066413 dated Mar. 18, 2014.

(Continued)

*Primary Examiner* — R. K. Arundale
*Assistant Examiner* — Daphne M Barry

(57) ABSTRACT

An advanced blowout preventer that includes an arrester section and a shear section. The arrester section includes a number or arrester rings that are shaped to extend downwardly. The shape of the arrester rings allows the force of gas flowing out of the well to assist in closing the rings. The arrester section may have a number of arrester rings that cooperate to significantly reduce fluid from flowing in the annulus between a section of drill pipe and the blowout preventer. The advanced blowout preventer may also include a shear section. The shear section is configured to engage and shear a section of pipe using induction.

15 Claims, 6 Drawing Sheets

(56) References Cited

U.S. PATENT DOCUMENTS

| | | | | |
|---|---|---|---|---|
| 7,018,289 | B2 * | 3/2006 | Heil | F16K 17/386 137/74 |
| 7,159,669 | B2 * | 1/2007 | Bourgoyne et al. | 166/382 |
| 8,692,515 | B2 | 4/2014 | Nakao et al. | |
| 9,388,657 | B2 | 7/2016 | Nelson | |
| 2001/0027814 | A1 * | 10/2001 | Stone | F16K 17/383 137/601.12 |
| 2007/0102655 | A1 | 5/2007 | Springett | 251/1.3 |
| 2011/0297396 | A1 | 12/2011 | Hendel | 166/379 |
| 2011/0315404 | A1 * | 12/2011 | Bailey et al. | 166/387 |
| 2012/0205561 | A1 * | 8/2012 | Baugh | 251/1.1 |
| 2012/0261137 | A1 * | 10/2012 | Martinez | E21B 34/06 166/373 |
| 2014/0014361 | A1 | 1/2014 | Nelson | |

FOREIGN PATENT DOCUMENTS

| | | |
|---|---|---|
| WO | WO 2011/084072 | 7/2011 |
| WO | WO/15/009574 | 1/2015 |

OTHER PUBLICATIONS

Office Action in Australian Application No. 2013334605 dated Feb. 16, 2017.

Office Action in New Zealand Application No. 708077 dated Jan. 16, 2017.

Office Action in European Application No. 13848591.7 dated Oct. 24, 2016.

Office Action in Chinese Application No. 201380055677.9 dated Nov. 2, 2016.

Office Action in Japanese Application No. 2015-539757 dated Jul. 4, 2017.

Notice of Reasons for Rejection issued in Japanese Patent Application No. 2015-539757, dated Jan. 26, 2018.

Office Action issued in Chinese Patent Application No. 201380055677.9, dated Nov. 2, 2016.

Office Action issued in Egyptian Patent Application No. PCT/NA/620/2015, dated Feb. 8, 2017.

Office Action issued in Egyptian Patent Application No. PCT/NA/620/2015, dated Jul. 18, 2017.

Office Action issued in Eurasian Patent Application No. 201590792, dated Oct. 5, 2016.

Office Action issued in Eurasian Patent Application No. 201590792, dated Mar. 24, 2017.

Office Action issued in Eurasian Patent Application No. 201590792, dated Nov. 29, 2017.

Office Action issued in Mexican Patent Application No. MX/a/2015/005196, dated Nov. 17, 2017.

Supplementary Partial European Search Report issued in European Patent Application No. 13848559.1, dated Oct. 24, 2016.

Written Opinion issued in International Patent Application No. PCT/US2013/066413, dated Mar. 18, 2014.

* cited by examiner

ADVANCED BLOW-OUT PREVENTER

REFERENCES TO CO-PENDING APPLICATIONS

This application claims the benefit of priority to U.S. Provisional Patent Application No. 61/717,459 to Bryce Levett, Gerard Ludtka, and Mariana Dionisio filed on Oct. 23, 2012 and entitled "Advanced Blow-Out Preventer," which is incorporated by reference in its entirety.

STATEMENT OF GOVERNMENT SUPPORT

This invention was made with Government support under Work for Others Agreement No. NFE-12-04104 awarded by the United States Department of Energy. The Government has certain rights in this invention.

BRIEF SUMMARY

The present invention is directed to a system and method for controlling wells and stopping blowouts once they have begun. One form of the invention is an arrester section that includes a first arrester that extends downwardly towards a wellhead, a second arrester that extends downwardly towards the wellhead and is positioned above and in-line with the first arrester; and a motor connected to the first arrester, the motor configured to open the first arrester when energized. The invention may further include an attachment point below the first arrester that is configured to be attached to a wellhead, shear section, existing BOP, or other common connector. The first arrester section may include blades configured to act together to close around a tubular member. The blades may be solid or include vents. For vented blades, at least some of the vents may be connected by veins.

Another form of the invention is an advanced BOP that includes an arrester section; a shear section; and a gripping section; wherein the gripping section is poisoned closest to a well head, followed by the shear section, and then the arrester section. The arrester section may include a first arrester extending downwardly towards the wellhead. The first arrester may comprise a number of arrester blades shaped to close around a tubular member. In another aspect of the invention at least one of the arrester blades is vented. Further, all or some of the vented blades include veins connected to a fluid source. The fluid source in one configuration is configured to hold coagulant, dispersant, or other material that might beneficially be supplied to vents. The arrester section of the advanced BOP may further include a second arrester positioned in line with said first arrester. The second arrester may include a number of vented arrester blades. It is also understood that the vents of the first arrester section define a first vented area; the vents of the second arrester section define a second vented area wherein the first vented area may be larger than the second vented area. The gripping section of the advanced BOP may include a pipe gripping cone extending upwardly from the wellhead. The advanced BOP may include a seal section positioned above the shear section that is designed to seal the well bore once tubular members extending into the well have been sheared. The advanced BOP may also include a retention section that is able to grip and suspend tubular members once they have been sheared.

Another form of the invention is an advanced BOP with an arrester section that includes at least one downwardly extending arrester ring; a shear section positioned below said arrester section; and a gripping section positioned below the shear section, wherein the arrester section, shear section, and gripping section define a passage through the BOP large enough to receive a tubular member. The shear section may include inductive shearing blades. The advanced BOP may further include a sealing ring positioned between said arrester section and said shear section. The arrester ring may be configured with overlapping blades that can be actuated to constrict inwardly to reduce the passage through the BOP. The arrester section of the advanced BOP may also include a second arrester ring positioned above said first arrester ring.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
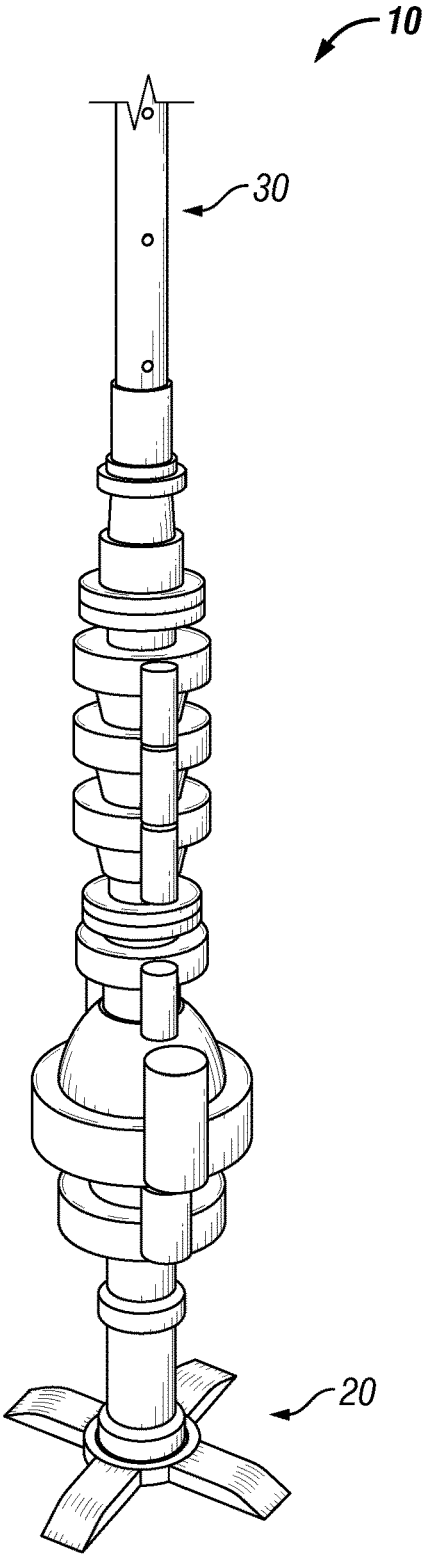
FIG. 1 is a view of an advanced BOP.

FIG. 1 shows the advanced Blowout preventer ("BOP") of applicant's invention. The lower portion of advanced BOP 10 is attached to well head 20 in a known manner. The upper portion is connected to riser 30.

Figure 2:
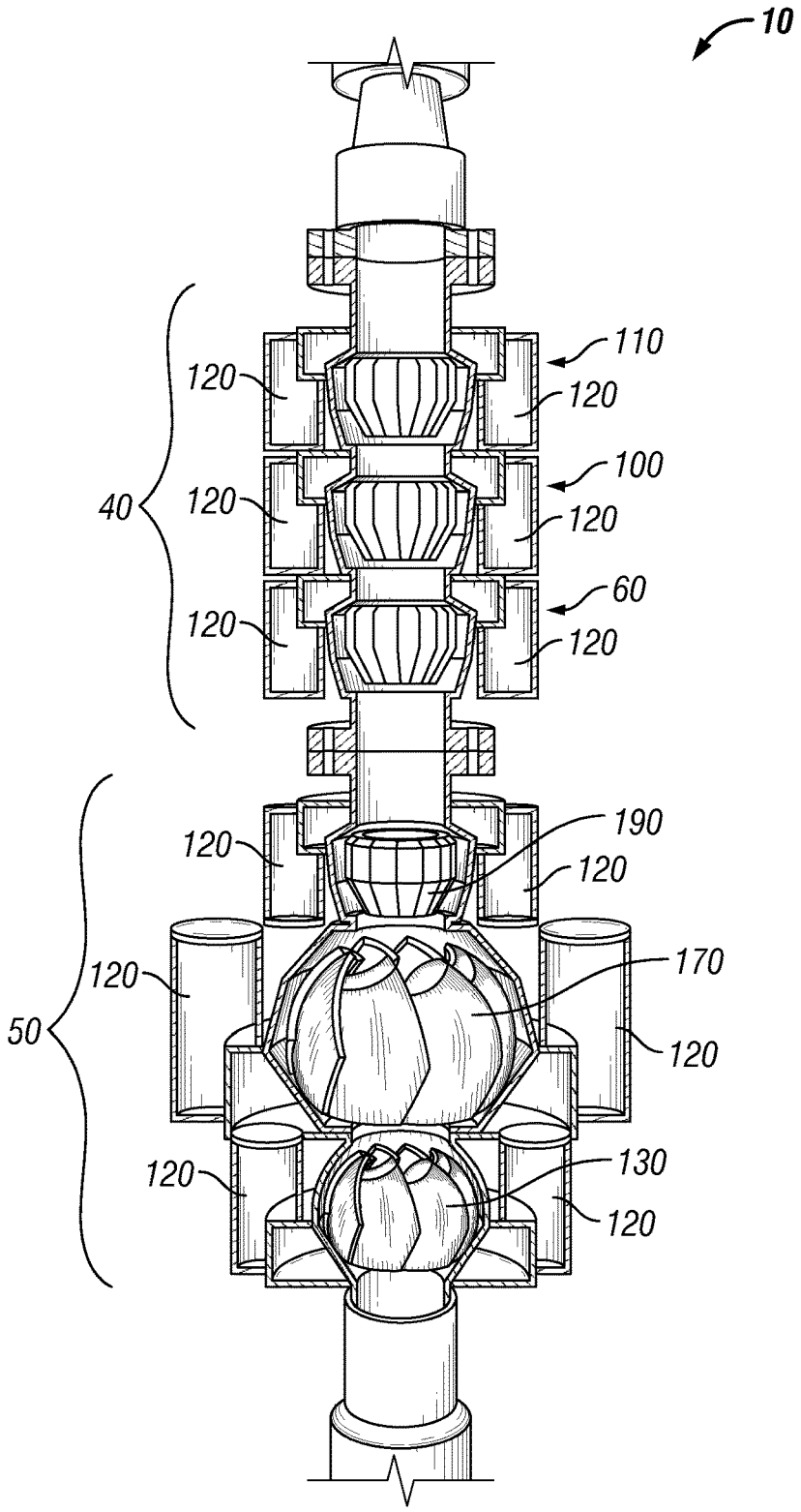
FIG. 2 is a view of an advanced BOP with the outer skin removed.

FIG. 2 shows a cutaway view of advanced BOP (10). The advanced BOP 10 includes a number of components designed to work cooperatively to provide well management, well containment, and blowout suppression. The upper portion is the blowout arrester section 40. The lower section is the shear section 50.

The blowout arrester section 40 includes a number of separate arrester rings. Although three arrester rings are shown, it is understood that the arrester section 40 could include more or less than three. The arrester rings are shown arranged in sequence, but may also be nested. The arrester rings are shown as being generally the same size and shape. However, one skilled in the art appreciates that different combinations of size and shape are within the spirit of the invention.

The arrester rings are designed to stop a blowout that is in progress. Each arrester ring is shown as being a series of overlapping blades that close around a tubular conduit such as a casing or drill pipe. The arrester rings extend downward towards the wellhead 20. During a blowout, discharge from the well moves rapidly up the BOP. As the arrester rings close, the escaping fluid and gas apply pressure to assist in closing the blades around the tubular conduit. In this manner, the force exerted by the material escaping the well assists in closing the arrester rings.

Figure 3:
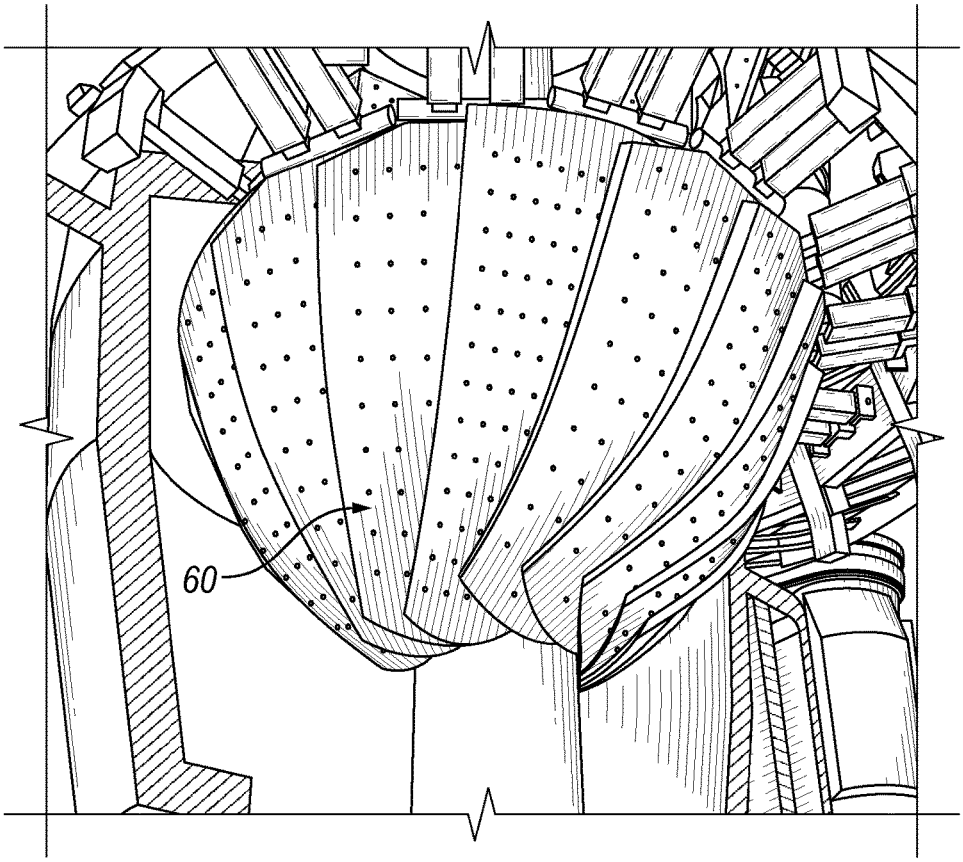
FIG. 3 is a view of a lower blowout arrester ring with vented blades.
Figure 4:
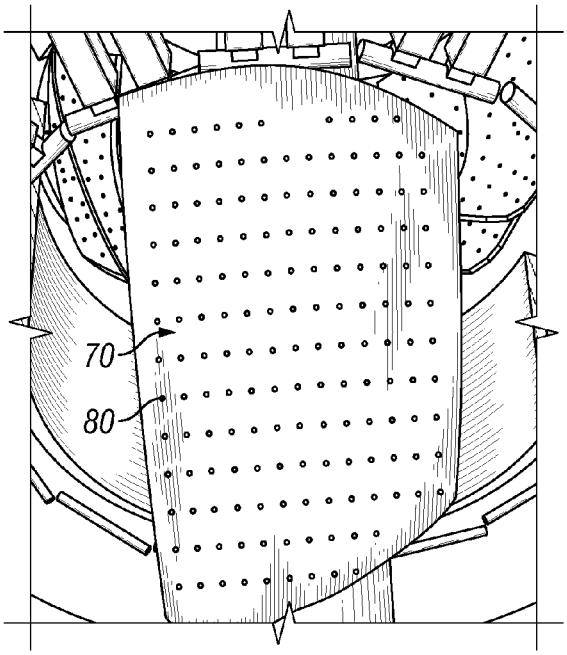
FIG. 4 is a view of a vented arrester blade.

The lowest arrester ring, arrester ring 60, is shown in FIG. 3 in a closed position. Arrester ring 60 is made from a number of blades that cooperate to close the well. FIG. 4 shows a single blade from the arrester ring 60. The blades are shown as being rounded. However, the blades may be straight or other shape.

Blade 70 is shown with a number of vents 80. The vents 80 are designed to reduce the force on the bade as the arrester ring is closed. Although vents 80 are shown in a geometric pattern, one skilled in the art appreciates that the vents can vary in size, shape, and position on blade 70. For example, vents 80 may be larger close to the open end of blade 70 to reduce the bending moment on blade 80. The arrester ring blades may be similar or different. For example, the blades may alternate between sold blades and vented blades. Alternatively, the arrester ring blades may all be solid.

It is also understood that the surface area of blade 70 may be substantially reduced by adjusting the number, size, and arrangement of vents 80. For example, vents 80 can be made large relative to the width of blade 70. In some configurations vents 80 can be made so large that blade 70 functions as a debris screen. Alternatively, vents 80 may be configured to act as a flow straightener to reduce flow turbulence. Alternatively, vents 80 may be configured to direct flow over instruments such as a parasitic power unit.

Arrester ring 60 may be configured to close against a tubular conduit. Alternatively, arrester ring 60 may be configured to be fully closed without contacting the tubular conduit. In configurations that close against the tubular conduit, blade 70 may include a shaped end that confirms to the tubular conduit.

Figure 5:
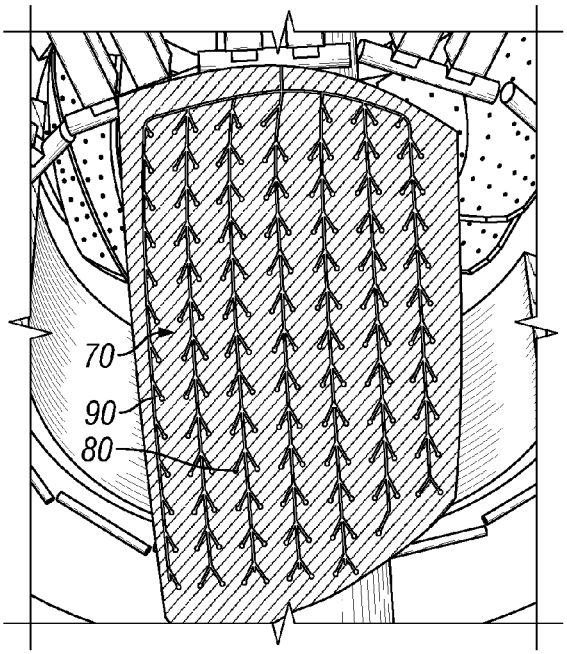
FIG. 5 is a semi-transparent view of coagulant veins in a vented arrester blade.

Blade 70 may also include veins 90. FIG. 5 shows veins 90 within blade 70. Veins 90 can be used for pumping coagulant into vents 80. Coagulant can be used to fill vents 80 to substantially stop all flow through blade 70. Veins 90 can also be used to introduce other substances into the annulus between the drill pipe and the wall of the BOP. For example, veins 90 can be used to deliver dispersant to escaping oil.

Arrester ring 100 is positioned above arrester ring 60. Arrester ring 100 may be the same as arrester ring 60 or different. The arrester rings are designed to work together cooperatively. For example, arrester ring 60 may slow escaping gas and oil and screen debris while arrester ring 100 closes in the well. In a preferred embodiment arrester ring 100 has fewer vents 80 than arrester ring 60. Alternatively, arrester ring 100 may not have any vents 80. With fewer vents 80, the blades of arrester ring 100 have more surface area. Arrester ring 110 is positioned above arrester ring 100 and is designed to work cooperatively with arresters rings 60 and 100. Each arrester ring may include arrester ring blades that are solid, vented, or combinations thereof.

Energy to move the arresters is supplied by motors 120. In a preferred embodiment, motors 120 are electric. However, one skill in the art understands that "motors" is a general term that applies to any mechanism that can be used to actuate the arresters. For example, hydraulic pressure may be used. The hydraulic pressure may be supplied from a reservoir or the surface.

The arresters rings are designed to be normally closed and must be held open with motors 120. In this manner, the arresters will close if motors 120 lose power.

Shear section 50 includes a pipe gripping ring 130, a shear ring 170, and seal ring 190. As with arrester section 40, shear section 50 is actuated using motors 120. Although each ring is in both the arrester section and shear section is shown with its own motor, one skilled in the art understands that a single motor could be used or one motor for the arrester section and one motor for the shear section.

Figure 6:
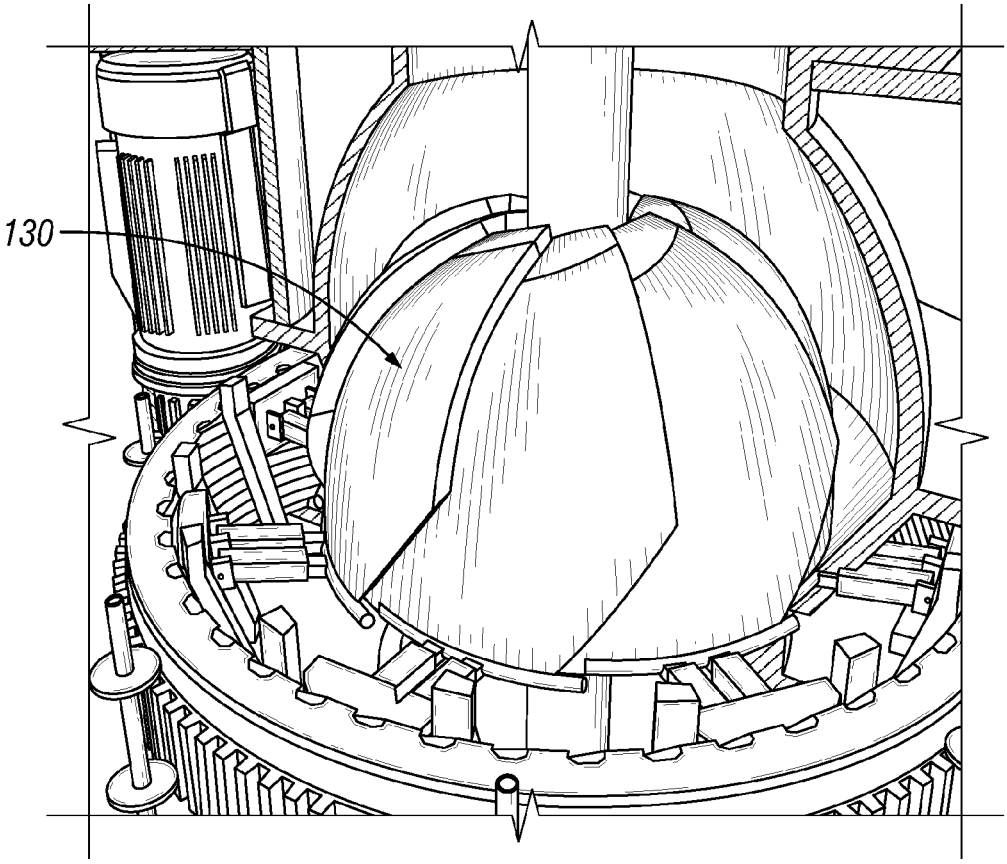
FIG. 6 is a view of a pipe gripping ring.

FIG. 6 shows pipe gripper ring 130. Pipe gripper ring 130 includes blades 140.

Figure 7:
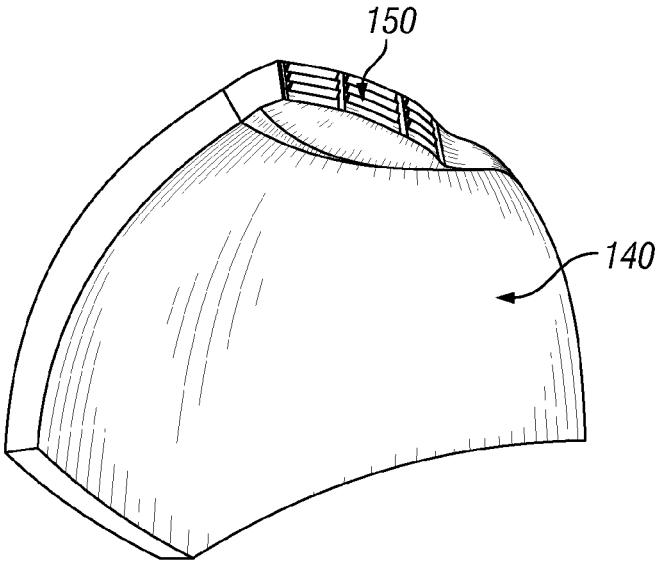
FIG. 7 is a view of a blade of the pipe gripping ring.

FIG. 7 shows a single blade of pipe gripper ring 130. Blade 140 includes a pipe gripping surface 150. The pipe gripping surface 150 is designed to engage a tubular member and support the string of tubular members that extend below pipe gripper ring 130. Gripping surface 150 work in a manner similar to pipe slips. Pipe gripper ring 130 extends upwardly from the well. In this configuration, the weight of the tubular members assist in closing and securing pipe gripper ring 130 around tubular members suspended in the well.

Figure 8:
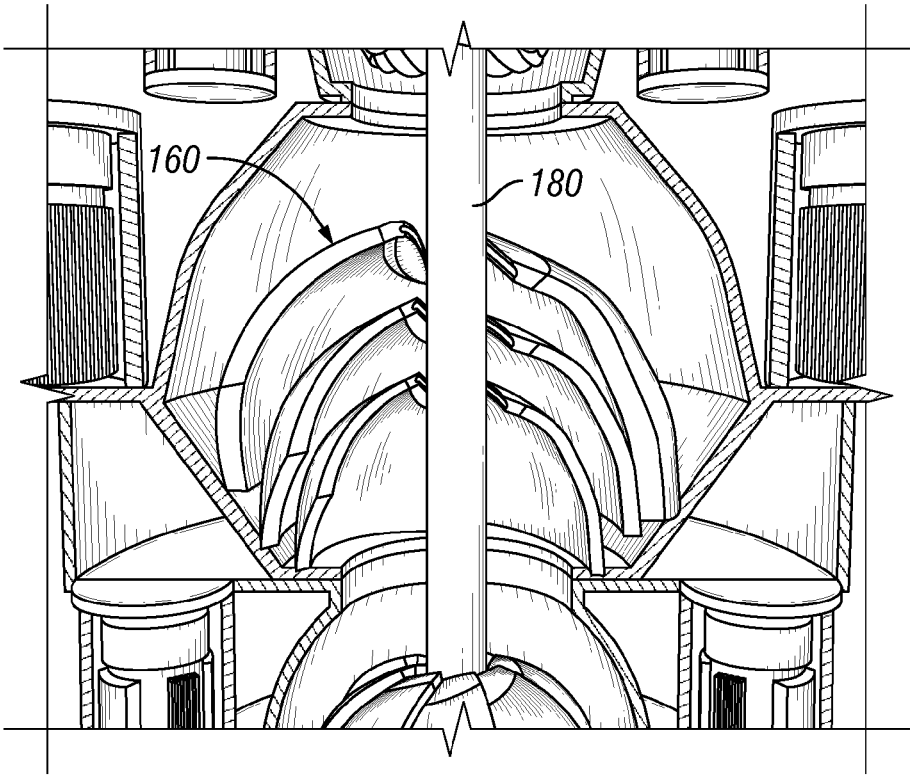
FIG. 8 is a cross-sectional view of nested inductive shear rings.
Figure 9:
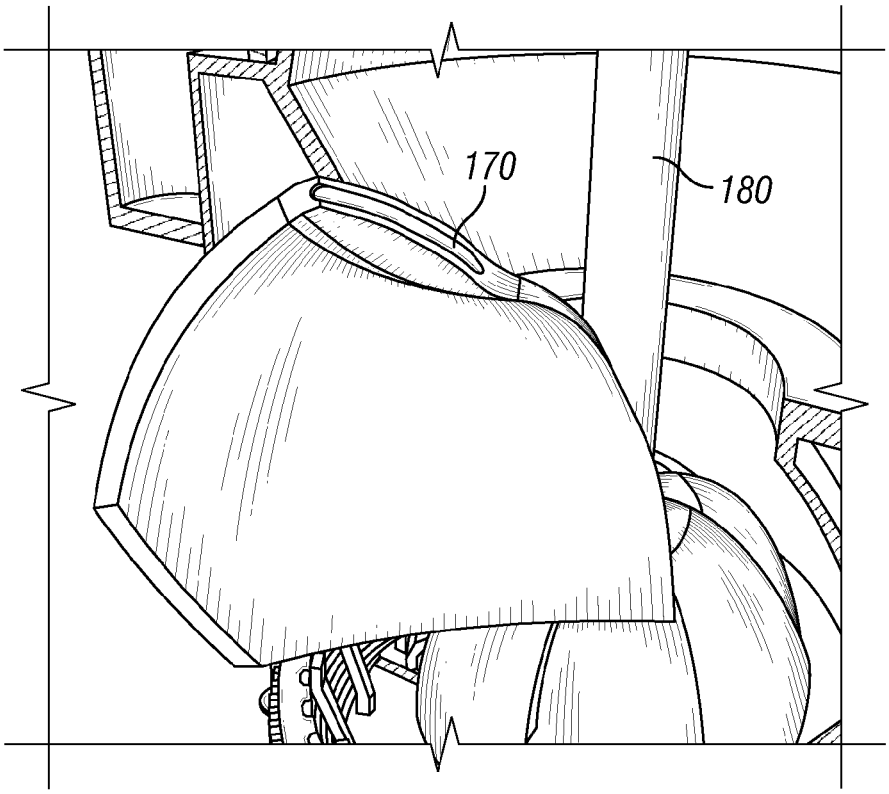
FIG. 9 is a view of an inductive shear blade.

FIG. 8 shows one method for cutting tubular members. FIG. 8 shows a nested arrangement of shear rings 160 configured with inductive coils. FIG. 9 shows a detailed view of a blade from a shear ring 160. The blade is designed to position inductive coil 170 in close proximity to tubular member 180. The nested arrangement allows for multiple inductive coils to be positioned in close proximity to tubular member 180. Although an inductive coil arrangement is shown, one skilled in the art would appreciate that more typical shear rams can be used.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The sections of the BOP are combined as shown in FIG. 1. Alternatively, the arrester section may be used independent of shear ring and gripping ring. In this manner, arrester section can be positioned above a typical BOP to provide arresting capability. Similarly, shear rings can be used independently of arrestors rings. In this manner, shear rings can be positioned above or below a typical BOP.

What is claimed is:

1. An advanced BOP configured to restrict flow through a conduit that extends longitudinally, the advanced BOP comprising:

an arrester section including:

a first arrester having blades that are hingedly coupled to a sidewall of the conduit and moveable between a retracted position and an extended position in which flow through the conduit is more restricted than when the blades are in the retracted position, each of the blades (1) having a first end and a second end, the first end being disposed longitudinally above the second end when the corresponding blade is in the retracted position, and (2) being hingedly coupled to the sidewall of the conduit at a location on the corresponding blade that is closer to the first end than to the second end; and a motor connected to the first arrester and configured to move the blades between the retracted position and the extended position in response to the motor being energized.

2. The advanced BOP of claim 1, wherein the blades extend downward towards a wellhead and inward towards an interior portion of the conduit, when the blades are in the extended position.

3. The advanced BOP of claim 2, wherein at least some of the blades include vents configured such that fluid that flows through the conduit flows through the vents past the blades when the blades are in the extended position.

4. The advanced BOP of claim 3, wherein each of the vented blades includes veins disposed within the blade and configured to direct a fluid to at least some of the vents.

5. The advanced BOP of claim 3, wherein the arrester section includes a second arrester positioned in fluid communication with the first arrester.

6. The advanced BOP of claim 5, wherein:

the second arrester includes blades that are moveable between a retracted position and an extended position in which flow through the conduit is more restricted than when the blades of the second arrester are in the retracted position; and at least some of the blades of the second arrester include vents configured such that fluid that flows through the conduit flows through the vents of the second arrester past the blades of the second arrester when the blades of the second arrester are in the extended position.

7. The advanced BOP of claim 6, wherein the vents of the first arrester define a first vented area, the vents of the second arrester define a second vented area, and the first vented area is larger than the second vented area.

8. The advanced BOP of claim 1, wherein, for each of the blades, when the blade is in the extended position, the blade overlaps an adjacent one of the blades.

9. The advanced BOP of claim 1, further comprising a shear section and a gripping section, the gripping section being positioned between a well head and the shear section, the shear section being positioned between the gripping section and the arrester section.

10. The advanced BOP of claim 9, wherein the gripping section includes pipe gripping blades that are moveable between a retracted position and an extended position in which the pipe gripping blades extend upward away from the wellhead and inward toward an interior portion of the conduit.

11. The advanced BOP of claim 9, further comprising a seal section positioned above the shear section and configured to seal the conduit.

12. The advanced BOP of claim 1, wherein the blades are configured such that, when fluid flows through the conduit, the fluid applies pressure to the blades such that the blades are urged toward the extended position.

13. The advanced BOP of claim 1, wherein the motor is connected to the first arrester such that:

when the motor is energized, the motor maintains the blades in the retracted position; and when the motor is de-energized, the blades move from the retracted position to the extended position.

14. An arrester section configured to restrict flow through a conduit, the arrester section comprising:

an arrester including:

blades that are moveable between a retracted position and an extended position in which flow through the conduit is more restricted than when the blades are in the retracted position, at least some of the blades include vents configured such that fluid that flows through the conduit flows through the vents past the blades having the vents when the blades are in the extended position; and a motor connected to the arrester and configured to move the blades between the extended position and the retracted position.

15. The arrester section of claim 14, wherein the motor is connected to the arrester such that:

when the motor is energized, the motor maintains the blades in the retracted position; and when the motor is de-energized, the blades move from the retracted position to the extended position.

* * * * *